US006846793B1

(12) United States Patent
Griese

(10) Patent No.: US 6,846,793 B1
(45) Date of Patent: Jan. 25, 2005

(54) CLEANING CONCENTRATE

(75) Inventor: Greg G. Griese, Hudson, WI (US)

(73) Assignee: Ecolab, Inc., St. Paul, MN (US)

( * ) Notice: Subject to any disclaimer, the term of this patent is extended or adjusted under 35 U.S.C. 154(b) by 0 days.

(21) Appl. No.: 10/643,570

(22) Filed: Aug. 19, 2003

Related U.S. Application Data

(63) Continuation-in-part of application No. 10/391,639, filed on Mar. 19, 2003, now Pat. No. 6,767,881.

(51) Int. Cl.[7] ..... C11D 1/70; C11D 1/72; C11D 3/37

(52) U.S. Cl. ..... 510/421; 510/201; 510/238; 510/239; 510/240; 510/245; 510/365; 510/426; 510/475; 510/506

(58) Field of Search ..... 510/201, 238, 510/239, 240, 245, 365, 421, 426, 475, 506

(56) References Cited

U.S. PATENT DOCUMENTS

| | | | | |
|---|---|---|---|---|
| 2,534,074 | A | 12/1950 | Shmidl | |
| 3,048,548 | A | 8/1962 | Martin et al. | |
| 3,334,147 | A | 8/1967 | Brunelle et al. | |
| 3,389,212 | A | 6/1968 | McCoy | |
| 3,417,023 | A | 12/1968 | Di Salvo | |
| 3,442,242 | A | 5/1969 | Laskey et al. | |
| 3,635,829 | A | 1/1972 | Yang | |
| 3,664,962 | A | 5/1972 | Kelly et al. | |
| 3,929,721 | A | 12/1975 | Leverett | |
| 3,953,353 | A | 4/1976 | Barrett, Jr. et al. | |
| 4,020,016 | A | 4/1977 | Sokol | |
| 4,199,482 | A | 4/1980 | Renaud et al. | |
| 4,289,644 | A | 9/1981 | Steinhauer et al. | |
| 4,295,845 | A | 10/1981 | Sepulveda et al. | |
| 4,362,638 | A | 12/1982 | Caskey et al. | |
| 4,396,521 | A | 8/1983 | Borrello | |
| 4,414,128 | A | * 11/1983 | Goffinet | 510/405 |
| 4,430,236 | A | 2/1984 | Franks | |
| 4,444,802 | A | 4/1984 | Winters et al. | |
| 4,448,703 | A | 5/1984 | Forsberg | |
| 4,457,857 | A | 7/1984 | Sepulveda et al. | |
| 4,508,879 | A | 4/1985 | Holubka | |
| 4,513,125 | A | 4/1985 | Holubka | |
| 4,514,325 | A | 4/1985 | Russo et al. | |
| 4,514,548 | A | 4/1985 | Holubka | |
| 4,514,549 | A | 4/1985 | Holubka | |
| 4,518,038 | A | 5/1985 | Maddox et al. | |
| 4,530,781 | A | 7/1985 | Gipp | |
| 4,595,527 | A | 6/1986 | Gipp | |
| 4,618,914 | A | 10/1986 | Sato et al. | |
| 4,627,931 | A | 12/1986 | Malik | |
| 4,711,739 | A | 12/1987 | Kandathil | |
| 4,732,704 | A | 3/1988 | Biermann et al. | |
| 4,749,509 | A | 6/1988 | Kacher | |
| 4,784,789 | A | 11/1988 | Jeschke et al. | |
| 4,830,773 | A | 5/1989 | Olson | |
| 4,836,949 | A | 6/1989 | Klajnscek | |
| 4,842,762 | A | 6/1989 | Sabol, Jr. et al. | |
| 4,851,324 | A | 7/1989 | Hsieh | |
| 4,861,516 | A | 8/1989 | Kurzendoerfer et al. | |
| 4,877,556 | A | 10/1989 | Wilsberg et al. | |
| 4,889,654 | A | 12/1989 | Mason et al. | |
| 4,909,962 | A | 3/1990 | Clark | |
| 4,911,860 | A | 3/1990 | Van Den Brom | |
| 4,954,286 | A | 9/1990 | Sepulveda et al. | |
| 5,035,826 | A | 7/1991 | Durbut et al. | |
| 5,080,822 | A | 1/1992 | VanEenam | |
| 5,080,831 | A | 1/1992 | VanEenam | |
| 5,158,710 | A | 10/1992 | VanEenam | |
| 5,205,960 | A | 4/1993 | Kristopeit et al. | |
| 5,288,420 | A | 2/1994 | Mandy | |
| 5,364,551 | A | 11/1994 | Lentsch et al. | |
| 5,370,729 | A | 12/1994 | Man et al. | |
| 5,399,672 | A | 3/1995 | Jalalian et al. | |
| 5,419,848 | A | 5/1995 | VanEenam | |
| 5,454,985 | A | 10/1995 | Harbin | |
| 5,484,553 | A | 1/1996 | Guth et al. | |
| 5,490,948 | A | 2/1996 | Klier et al. | |
| 5,503,838 | A | 4/1996 | Schmidt et al. | |
| 5,538,662 | A | 7/1996 | Klier et al. | |
| 5,585,341 | A | 12/1996 | VanEenam | |
| 5,648,326 | A | 7/1997 | Sramek | |
| 5,750,484 | A | 5/1998 | Falbaum et al. | |
| 5,770,708 | A | 6/1998 | Bermes | |
| 5,849,682 | A | 12/1998 | Van Eenam | |
| 6,010,995 | A | 1/2000 | Van Eenam | |
| 6,204,233 | B1 | 3/2001 | Smith et al. | |
| 6,767,881 | B1 | * 7/2004 | Griese et al. | 510/421 |
| 2002/0058600 | A1 | 5/2002 | Van Eenam | |

FOREIGN PATENT DOCUMENTS

| | | |
|---|---|---|
| GB | 2079771 | 1/1982 |
| WO | WO 91/09104 | 6/1991 |
| WO | WO 96/26999 | 9/1996 |
| WO | WO 97/00934 | 9/1997 |
| WO | WO 01/14481 | 3/2001 |
| WO | WO 02/06436 | 1/2002 |
| WO | WO 02/06437 | 1/2002 |
| WO | WO 02/08373 | 1/2002 |

* cited by examiner

*Primary Examiner*—Brian P. Mruk
(74) *Attorney, Agent, or Firm*—Crompton Seager & Tufte

(57) ABSTRACT

Compositions of the invention include: a surfactant having an HLB value from 1 to 10; and a compound of formula (I):

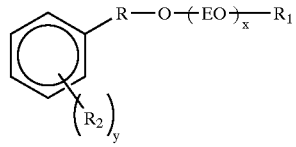

(I)

where; x is an integer from 2 to 6, y is an integer from 0 to 5, R is a bond or $(C_1–C_4)$alkylene, $R_1$ is a hydrogen, halo, aryl, $(C_1–C_4)$alkyl, heteroaryl, cycloalkyl, or heterocycyl, $R_2$ is independently selected from hydrogen, halo, $(C_1–C_4)$ alkyl, $(C_1–C_4)$alkoxy, $(C_2–C_4)$ alkenylene. Methods forming stable aqueous and non-aqueous solutions of the same are also provided.

19 Claims, No Drawings

CLEANING CONCENTRATE

CROSS-REFERENCE TO RELATED APPLICATIONS

This application is a continuation-in-part of U.S. patent application Ser. No. 10/391,639, filed Mar. 19, 2003 now U.S. Pat. No. 6,767,881.

BACKGROUND OF THE INVENTION

The invention relates to cleaner/degreaser compositions and, more particularly, to stable cleaner/degreaser compositions that include a surfactant with an HLB less than 10, and an aryl ethoxylate.

While not wishing to be held to any theory as to the nature of the cleaning and degreasing action of presently available compositions, it is believed that highly or infinitely water soluble organic solvents presently used in both retail as well as industrial and institutional cleaner/degreaser compositions are too hydrophilic in nature to function effectively in removing hydrophobic "oleophilic" soilants, especially in the presence of diluting water. As the level of the latter is increased to bring conventional compositions to ready to use strength, the solvating action of the organic solvent is drastically reduced with a consequent and marked reduction in the cleaning/degreasing action required for effective cleaning and oily soilant removal.

There remains a need, therefore, for cleaning, degreaser compositions with improved cleaning and degreasing capabilities without the other deficiencies of presently available cleaner/degreaser compositions.

SUMMARY OF THE INVENTION

Generally, the present invention relates to low HLB and aryl ethoxylate based cleaning compositions that are stable in concentrate and dilute use solution form.

One embodiment of the invention includes a composition including: a surfactant having an HLB value from 1 to 10; and a compound of formula (I):

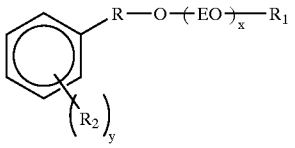

(I)

where; x is an integer from 2 to 6, y is an integer from 0 to 5, R is a bond or $(C_1–C_4)$alkylene, $R_1$ is a hydrogen, halo, aryl, $(C_1–C_4)$alkyl, heteroaryl, cycloalkyl, or heterocycyl, $R_2$ is independently selected from hydrogen, halo, $(C_{1-4})$ alkyl, $(C_1–C_4)$alkoxy, $(C_2–C_4)$ alkenylene.

Another embodiment of the invention includes a method of forming a stable cleaning composition that includes combining: a surfactant having an HLB value from 1 to 10, (b) a compound of formula (I):

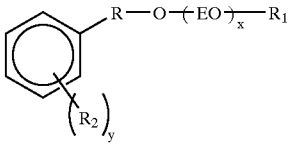

(I)

where; x is an integer from 2 to 6, y is an integer from 0 to 5, R is a bond or $(C_1–C_4)$alkylene, $R_1$ is hydrogen, halo, aryl, $(C_1–C_4)$alkyl, heteroaryl, cycloalkyl, or heterocycyl, $R_2$ is independently selected from hydrogen, halo, $(C_1–C_4)$alkyl, $(C_1–C_4)$alkoxy, $(C_2–C_4)$ alkenylene, and a second surfactant having an HLB value greater than 10 forming a stable non-aqueous cleaning concentrate or water forming an aqueous cleaning concentrate.

The above summary of the present invention is not intended to describe each disclosed embodiment or every implementation of the present invention. The Detailed Description and Examples which follow more particularly exemplify these embodiments

DETAILED DESCRIPTION

While the invention is amenable to various modifications and alternative forms, specifics thereof have been shown by way of the Example and will be described in detail. It should be understood, however, that the intention is not to limit the invention to the particular embodiments described. On the contrary, the intention is to cover all modifications, equivalents, and alternatives falling within the spirit and scope of the invention.

For the following defined terms, these definitions shall be applied, unless a different definition is given in the claims or elsewhere in this specification.

All numeric values are herein assumed to be modified by the term "about," whether or not explicitly indicated. The term "about" generally refers to a range of numbers that one of skill in the art would consider equivalent to the recited value (i.e., having the same function or result). In many instances, the terms "about" may include numbers that are rounded to the nearest significant figure.

Weight percent, percent by weight, % by weight, and the like are synonyms that refer to the concentration of a substance as the weight of that substance divided by the weight of the composition and multiplied by 100.

The recitation of numerical ranges by endpoints includes all numbers subsumed within that range (e.g. 1 to 5 includes 1, 1.5, 2, 2.75, 3, 3.80, 4, and 5).

As used in this specification and the appended claims, the singular forms "a", "an", and "the" include plural referents unless the content clearly dictates otherwise. Thus, for example, reference to a composition containing "a compound" includes a mixture of two or more compounds. As used in this specification and the appended claims, the term "or" is generally employed in its sense including "and/or" unless the content clearly dictates otherwise.

The term "alkyl" refers to a straight or branched chain monovalent hydrocarbon radical having a specified number of carbon atoms. Alkyl groups may be unsubstituted or substituted with substituents that do not interfere with the specified function of the composition and may be substituted once or twice with the same or different group. Substituents may include alkoxy, hydroxy, mercapto, amino, alkyl substituted amino, nitro, carboxy, carbanoyl, carbanoyloxy, cyano, methylsulfonylamino, or halo, for example.

Examples of "alkyl" include, but are not limited to, methyl, ethyl, n-propyl, isopropyl, n-butyl, s-butyl, t-butyl, n-pentyl, n-hexyl, 3-methylpentyl, and the like.

As used herein, the term "alkylene" refers to a straight or branched chain divalent hydrocarbon radical having a specified number of carbon atoms. Alkylene groups include those with one to twenty carbon atoms. Alkylene groups may be unsubstituted or substituted with those substituents that do not interfere with the specified function of the composition. Substituents include alkoxy, hydroxy, mercapto, amino, alkyl substituted amino, or halo, for example. Examples of "alkylene" as used herein include, but are not limited to, methylene, ethylene, propane-1,3-diyl, propane-1,2-diyl and the like.

The term "alkoxy" refers to refers to a straight or branched chain monovalent hydrocarbon radical having a specified number of carbon atoms and a carbon-oxygen-carbon bond, may be unsubstituted or substituted with substituents that do not interfere with the specified function of the composition and may be substituted once or twice with the same or different group. Substituents may include alkoxy, hydroxy, mercapto, amino, alkyl substituted amino, nitro, carboxy, carbanoyl, carbanoyloxy, cyano, methylsulfonylamino, or halo, for example. Examples include, methoxy, ethoxy, propoxy, t-butoxy, and the like.

The term "alkenyl" or "alkenylene" refers to a straight or branched chain divalent hydrocarbon radical having a specified number of carbon atoms and one or more carbon—carbon double bonds. Alkenylene groups may be unsubstituted or substituted with substituents that do not interfere with the specified function of the composition and may be substituted once or twice with the same or different group. Substituents may include alkoxy, hydroxy, mercapto, amino, alkyl substituted amino, nitro, carboxy, carbanoyl, carbanoyloxy, cyano, methylsulfonylamino, or halo, for example. Examples of "alkenyl" or "alkenylene" include, but are not limited to, ethene-1,2-diyl, propene-1,3-diyl, and the like.

The term "cycloalkyl" refers to an alicyclic hydrocarbon group having a specified number of carbon atoms. Cycloalkyl groups include those with one to twelve carbon atoms. Cycloalkyl groups may be saturated or unsaturated, unsubstituted or substituted with those substituents that do not interfere with the specified function of the composition. Cycloalkyl may be substituted by halo, $C_1$–$C_6$ alkyl, $C_1$–$C_6$ alkoxy, $C_2$–$C_6$ alkenyl, substituted $C_1$–$C_6$ alkyl, $C_1$–$C_6$ substituted alkoxy, substituted $C_2$–$C_6$ alkenyl, substituted alkoxy, amino, nitro, cyano, carboxy, hydroxymethyl, aminomethyl, carboxymethyl, $C_1$–$C_4$ alkylthio, hydroxy, $C_1$–$C_4$ alkanoyloxy, carbamoyl, or halo-substituted $C_1$–$C_6$ alkyl and may be substituted once or more with the same or different group. Such a cycloalkyl ring may be optionally fused to one or more of another heteroaryl ring(s), aryl ring(s), or cycloalkyl rings. Examples of "cycloalkyl" include, but are not limited to, cyclopropyl, cyclobutyl, cyclopentyl, cyclohexyl, cycloheptyl, or cyclooctyl, and the like.

The term "heterocyclic" or "heterocyclyl" refers to a monovalent three to twelve-membered non-aromatic ring containing one or more heteroatomic substitutions independently selected from S, O, or N and having zero to five degrees of unsaturation. Heterocyclyl groups may be unsubstituted or substituted with those substituents that do not interfere with the specified function of the composition. Heterocyclyl may be substituted by halo, $C_1$–$C_6$ alkyl, $C_1$–$C_6$ alkoxy, $C_2$–$C_6$ alkenyl, substituted $C_1$–$C_6$ alkyl, $C_1$–$C_6$ substituted alkoxy, substituted $C_2$–$C_6$ alkenyl, substituted alkoxy, amino, nitro, cyano, carboxy, hydroxymethyl, aminomethyl, carboxymethyl, $C_1$–$C_4$ alkylthio, hydroxy, $C_1$–$C_4$ alkanoyloxy, carbamoyl, or halo-substituted $C_1$–$C_6$ alkyl and may be substituted once or more with the same or different group. Such a heterocyclic ring may be optionally fused to one or more of another heterocyclic ring(s), heteroaryl ring(s), aryl ring(s), or cycloalkyl rings. Examples of "heterocyclic" include, but are not limited to, tetrahydrofuryl, pyranyl, 1,4-dioxanyl, 1,3-dioxanyl, piperidinyl, pyrrolidinyl, morpholinyl, tetrahydrothiopyranyl, tetrahydrothiophenyl, and the like.

The term "aryl" refers to monovalent unsaturated aromatic carbocyclic radicals having a single ring, such as phenyl, or multiple condensed rings, such as naphthyl or anthryl. Aryl groups may be unsubstituted or substituted with those substituents that do not interfere with the specified function of the composition. Aryl may be substituted by halo, $C_1$–$C_6$ alkyl, $C_1$–$C_6$ alkoxy, $C_2$–$C_6$ alkenyl, substituted $C_1$–$C_6$ alkyl, $C_1$–$C_6$ substituted alkoxy, substituted $C_2$–$C_6$ alkenyl, substituted alkoxy, amino, nitro, cyano, carboxy, hydroxymethyl, aminomethyl, carboxymethyl, $C_1$–$C_4$ alkylthio, hydroxy, $C_1$–$C_4$ alkanoyloxy, carbamoyl, or halo-substituted $C_1$–$C_6$ alkyl and may be substituted once or more with the same or different group. Such an aryl ring may be optionally fused to one or more of another heterocyclic ring(s), heteroaryl ring(s), aryl ring(s), or cycloalkyl rings. Examples of "aryl" include, but are not limited to, phenyl, 2-naphthyl, 1-naphthyl, biphenyl, 2-hydroxyphenyl, 2-aminophenyl, 2-methoxyphenyl and the like.

The term "heteroaryl" refers to a monovalent five to seven membered aromatic ring radical containing one or more heteroatoms independently selected from S, O, or N. Heteroaryl groups may be unsubstituted or substituted with those substituents that do not interfere with the specified function of the composition. Heteroaryl may be substituted by halo, $C_1$–$C_6$ alkyl, $C_1$–$C_6$ alkoxy, $C_2$–$C_6$ alkenyl, substituted $C_1$–$C_6$ alkyl, $C_1$–$C_6$ substituted alkoxy, substituted $C_2$–$C_6$ alkenyl, substituted alkoxy, amino, nitro, cyano, carboxy, hydroxymethyl, aminomethyl, carboxymethyl, $C_1$–$C_4$ alkylthio, hydroxy, $C_1$–$C_4$ alkanoyloxy, carbamoyl, or halo-substituted $C_1$–$C_6$ alkyl and may be substituted once or more with the same or different group. Such a "heteroaryl" ring may be optionally fused to one or more of another heterocyclic ring(s), heteroaryl ring(s), aryl ring(s), or cycloalkyl rings. Examples of "heteroaryl" include, but are not limited to, furyl, thiophenyl, pyrrolyl, imidazolyl, pyrazolyl, triazolyl, tetrazolyl, thiazolyl, oxazolyl, isoxazolyl, oxadiazolyl, thiadiazolyl, isothiazolyl, pyridinyl, pyridazinyl, pyrazinyl, pyrimidinyl, quinolinyl, isoquinolinyl, benzofuryl, benzothiophenyl, indolyl, and indazolyl, and the like.

The term "halo" and "halogen" refer to chloro, bromo, fluoro, and iodo.

The term "EO" refers to ethylene oxide.

The term "PO" refers to propylene oxide.

The term "Hydrophilic Lipophilic Balance (HLB)" refers to a surfactant's solubility in water. An HLB scale was derived as a means for comparing the relative hydrophilicity of amphiphilic molecules. Molecules with an HLB value of 10 or greater indicate that the molecule is hydrophilic and soluble in water. Molecules with an HLB value less than 10 indicate that the molecule is hydrophobic and insoluble in water. The HLB system is well known to skilled surfactant chemists and is explained in the literature such as in the publication, "The HLB System," ICI Americas (1987).

The term "surfactant" or "surface active agent" refers to an organic chemical that when added to a liquid changes the properties of that liquid at a surface.

Compositions

The compositions of the invention include a surfactant with an HLB less hand 10, an aryl ethoxylate and optionally with a surfactant with an HLB greater than 10 or water. The composition forms a stable cleaning concentrate and remains stable when diluted to a use solution. The stable cleaning concentrate may be a stable single phase solution or a stable micro emulsion.

One embodiment of the invention includes a composition including: a surfactant having an HLB value from 1 to 10; and a compound of formula (I):

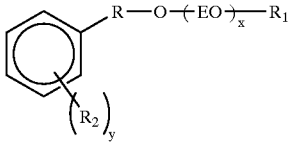

(I)

where; x is an integer from 2 to 6, y is an integer from 0 to 5, R is a bond or $(C_1–C_4)$alkylene, $R_1$ is a hydrogen, halo, aryl, $(C_1–C_4)$alkyl, heteroaryl, cycloalkyl, or heterocycyl, $R_2$ is independently selected from hydrogen, halo, $(C_1–C_4)$ alkyl, $(C_1–C_4)$alkoxy, $(C_2–C_4)$ alkenylene.

Another embodiment includes a method of forming a stable cleaning composition that includes combining: a surfactant having an HLB value from 1 to 10, a compound of formula (I):

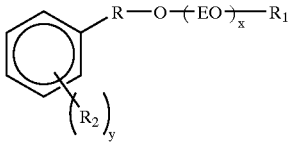

(I)

where; x is an integer from 2 to 6, y is an integer from 0 to 5, R is a bond or $(C_1–C_4)$alkylene, $R_1$ is hydrogen, halo, aryl, $(C_1–C_4)$alkyl, heteroaryl, cycloalkyl, or heterocycyl, $R_2$ is independently selected from hydrogen, halo, $(C_1–C_4)$alkyl, $(C_1–C_4)$alkoxy, $(C_2–C_4)$ alkenylene, and a second surfactant having an HLB value greater than 10 forming a stable non-aqueous cleaning concentrate or water forming an aqueous cleaning concentrate.

The composition can include 10 to 90 wt % of a surfactant having an HLB value from 1 to 10 based on the total weight of surfactant having an HLB value from 1 to 10 and aryl ethoxylate. The composition can include 25 to 75 wt % of aryl ethoxylate based on the total weight of surfactant having an HLB value from 1 to 10 and aryl ethoxylate. The composition can have a weight ratio of aryl ethoxylate to surfactant having an HLB value from 1 to 10 of 1:3 to 3:1. The composition can be diluted with a solvent or water from 1–99% wt % aryl ethoxylate and surfactant having an HLB value from 1 to 10.

Surfactant

A surfactant may be present in the composition of the invention. The surfactant or surfactant admixture can be selected from water soluble or water dispersible nonionic, semi-polar nonionic, anionic, cationic, amphoteric, or zwitterionic surface-active agents; or any combination thereof. The surfactant can be a specified combination of surfactants such as, for example, a anionic and nonionic surfactant, a anionic and two or more nonionic surfactants, or a anionic and a hydrophobic nonionic and a hydrophilic nonionic surfactant. The particular surfactant or surfactant mixture chosen for use in the process and products of this invention can depend on the conditions of final utility, including method of manufacture, physical product form, use pH, use temperature, foam control, and soil type.

Anionic surfactants may include, for example, carboxylates such as alkylcarboxylates (carboxylic acid salts) and polyalkoxycarboxylates, alcohol ethoxylate carboxylates, nonylphenol ethoxylate carboxylates, and the like; sulfonates such as alkylsulfonates, alkylbenzenesulfonates, alkylarylsulfonates, sulfonated fatty acid esters, and the like; sulfates such as sulfated alcohols, sulfated alcohol ethoxylates, sulfated alkylphenols, alkylsulfates, sulfosuccinates, alkylether sulfates, and the like; and phosphate esters such as alkylphosphate esters, and the like.

Nonionic surfactants may include those having a polyalkylene oxide polymer as a portion of the surfactant molecule. Such nonionic surfactants include, for example, chlorine-, benzyl-, methyl-, ethyl-, propyl-, butyl- and other like alkyl-capped polyethylene glycol ethers of fatty alcohols; polyalkylene oxide free nonionics such as alkyl polyglycosides; sorbitan and sucrose esters and their ethoxylates; alkoxylated ethylene diamine; alcohol alkoxylates such as alcohol ethoxylate propoxylates, alcohol propoxylates, alcohol propoxylate ethoxylate propoxylates, alcohol ethoxylate butoxylates, and the like; nonylphenol ethoxylate, polyoxyethylene glycol ethers and the like; carboxylic acid esters such as glycerol esters, polyoxyethylene esters, ethoxylated and glycol esters of fatty acids, and the like; carboxylic amides such as diethanolamine condensates, monoalkanolamine condensates, polyoxyethylene fatty acid amides, and the like; and polyalkylene oxide block copolymers including an ethylene oxide/propylene oxide block copolymer such as those commercially available under the trademark PLURONIC™ (BASF-Wyandotte), and the like; and other like nonionic compounds. Silicone surfactants such as the ABIL™ B8852 can also be used.

Cationic surfactants useful for inclusion in a cleaning composition for sanitizing or fabric softening, include amines such as primary, secondary and tertiary monoamines with $C_{18}$ alkyl or alkenyl chains, ethoxylated alkylamines, alkoxylates of ethylenediamine, imidazoles such as a 1-(2-hydroxyethyl)-2-imidazoline, a 2-alkyl-1-(2-hydroxyethyl)-2-imidazoline, and the like; and quaternary ammonium salts, as for example, alkylquaternary ammonium chloride surfactants such as n-alkyl$(C_{12}–C_{18})$dimethylbenzyl ammonium chloride, n-tetradecyl dimethylbenzylammonium chloride monohydrate, a naphthylene-substituted quaternary ammonium chloride such as dimethyl-1-naphthylmethylammonium chloride, and the like; and other like cationic surfactants.

Surfactants may also be categorized as hydrophobic or hydrophilic surfactants. Hydrophobic surfactants posses an HLB value of less than 10. Hydrophilic surfactants possess an HLB value of 10 or greater. Surfactants with an HLB value from 1 to 10 may include, for example, primary alcohol ethoxylate, secondary alcohol ethoxylate, ternary alcohol ethoxylate, primary amine ethoxylate, and secondary amine ethoxylate. Surfactants with an HLB value from 1 to 10 further include, for example alkyl polysaccharides, alkylamine ethoxylates, block copolymers, castor oil ethoxylates, ceto-oleyl alcohol ethoxylates, ceto-stearyl alcohol ethoxylates, decyl alcohol ethoxylates, end-capped ethoxylates, ethoxylated alkanolamides, fatty alcohol alkoxylates, lauryl alcohol ethoxylates, mono-branched alcohol ethoxylates, random copolymer alkoxylates, sorbitan ester ethoxylates, stearic acid ethoxylates, synthetic alcohol ethoxylates, tall oil fatty acid ethoxylates, tallow amine ethoxylates. All of these surfactants have low HLB species and are widely commercially available from, for example, Huntsman Chemical Company (Houston, Tex.).

A hydrophobic surfactant may have a formula (II):

$$R'—O—(EO)_a(PO)_bR'' \quad (II)$$

where a is an integer from 1 to 10 or 1 to 5, b is an integer from 0 to 5 or 0, R' is ($C_6$–$C_{22}$ or $C_8$–$C_{16}$)alkyl, ($C_6$–$C_{22}$) alkoxy, ($C_6$–$C_{22}$) alkenylene with the proviso that when R' is $C_6$ alkyl, $C_6$ alkoxy, or $C_6$ alkenylene, a is at least 1 and b is at least 1, and R" is a hydrogen, halo, aryl, ($C_1$–$C_4$)alkyl, heteroaryl, cycloalkyl, or heterocycyl.

Exemplary hydrophobic surfactants include Tomadol 1-3 (HLB 8.7), Tomadol 25-3 (HLB 7.5), Tomadol 91-2.5 (HLB 8.5), Tomadol 23-1 (HLB 3.7), Surfonic L24-2 (HLB 6.2), Surfonic L241.3 (HLB 4.5), and Condea Vista 6-1EO-1PO (HLB 4.3). Tomadols are commercially available from Tomah Products Inc. (Milton, Wis.). Surfonics are commercially available from Huntsman Chemical (Houston, Tex.). Condea Vistas are commercially available from Condea Vista Inc., (Houston, Tex.).

As will be apparent to those skilled in the art, the above-listed hydrophobic surfactants are merely illustrative and various other hydrophobic surfactants meeting the criteria set out above may also be used in the practice of the invention. The hydrophobic surfactants may be present in the composition from 1 wt %, 10 to 90 wt % or 25 to 75 wt % based on the total weight of hydrophobic surfactant, and aryl ethoxylate.

Surfactants with an HLB value greater than 10 may be added to the composition and may include, for example, hydrophilic anionic surfactants such as, dodecylbenzenesulfonic acid, sodium dodecylbenzene sulfonate, potassium dodecylbenzene sulfonate, triethanolamine dodecylbenzene sulfonate, morpholinium dodecylbenzene sulfonate, ammonium dodecylbenzene sulfonate, isopropylamine dodecylbenzene sulfonate, sodium tridecylbenzene sulfonate, sodium dinonylbenzene sulfonate, potassium didodecylbenzene sulfonate, dodecyl diphenyloxide disulfonic acid, sodium dodecyl diphenyloxide disulfonate, isopropylamine decyldiphenyloxide disulfonate, sodium hexadecyloxy-poly (ethyleneoxy) (10)ethyl sulfonate, potassium octylphenoxy poly(ethyleneoxy)(9)ethyl sulfonate, sodium $C_{12-14}$ olefin sulfonate, sodium hexadecane-1 sulfonate, sodium ethyl oleate sulfonate, potassium octadecenylsuccinate, sodium oleate, potassium laurate, triethanolamine myristate, morpholinium tallate, potassium tallate, sodium lauryl sulfate, diethanolamine lauryl sulfate, sodium laureth (3) sulfate, ammonium laureth (2) sulfate, sodium nonylphenoxypoly (ethyleneoxy)(4) sulfate, sodium diisobutylsulfosuccinate, disodium laurylsulfosuccinate, tetrasodium N-laurylsulfosuccinimate, sodium decyloxypoly (ethyleneoxy(5)methyl)carboxylate, sodium octylphenoxy poly(ethyleneoxy(8)methyl) carboxylate, sodium mono decyloxy poly(ethyleneoxy)(4)phosphate, sodium didecyloxy poly(ethyleneoxy)(6) phosphate, and potassium mono/di octylphenoxy poly(ethyleneoxy)(9)phosphate. Useful hydrophilic nonionic surfactants include, for example, octylphenoxy poly(ethylene-oxy)-(11)ethanol, nonylphenoxy poly(ethyleneoxy)(13)ethanol, dodecylphenoxy poly (ethyleneoxy)(10)ethanol, polyoxyethylene (12) lauryl alcohols polyoxyethylene (14) tridecyl alcohol, lauryloxy poly (ethyleneoxy) (10) ethyl methyl ether, undecyl thiopoly (ethyleneoxy) (12) ethanol, methoxy poly(oxy-etyhylene-(10)/oxypropylene(20))2-propanol block copolymer, nonyloxy poly(propyleneoxy) (4)/(ethyleneoxy) (16) ethanol, dodecyl polyglycoside, polyoxyethylene (9) monolaurate, polyoxyethylene (8) monoundecanoate, polyoxyethylene (20) sorbitan monostearate, polyoxyethylene (18) sorbitol monotallate, sucrose monolaurate, lauryldimethylamine oxide, myristyldimethylamine oxide, lauramidopropyl-N,N-dimethylamine oxide, 1:1 lauric diethanolamide, 1:1 coconut diethanolamide, 1:1 mixed fatty acid diethanolamide, polyoxyethylene(6)lauramide, 1:1 soya diethanolamido poly-(ethyleneoxy)(8)ethanol, coconut diethanolamide, "modified"; and coconut diethanolamide, "long chain modified". Useful hydrophilic cationic surfactants include, for example, a mixture of n-alkyl ($C_{12}$ 50%, $C_{14}$ 30%, $C_{16}$ 17%, $C_{18}$3%) dimethyl ethylbenzyl ammonium chlorides, hexadecyltrimethylammonium methosulfate, didecyldimethylammonium bromide and a mixture of n-alkyl (68% $C_{12}$, 32% $C_{14}$) dimethyl benzyl ammonium chlorides. Useful hydrophilic amphoteric surfactants include cocamidopropyl betaine, sodium palmityloamphopropionate, N-coco beta-aminopropionic acid, disodium N-lauryliminodipropionate, sodium coco imidazoline amphoglycinate and coco betaine.

As will be apparent to those skilled in the art, the above-listed hydrophilic surfactants are merely illustrative and various other hydrophilic surfactants meeting the criteria set out above may also be used in the practice of the invention. Hydrophilic surfactants are not needed in the compositions of the invention to form stable concentrates and diluted use solutions. The hydrophilic surfactants may be present in the composition from 1 wt % or 5 to 90 wt % based on the total weight of hydrophobic surfactant, hydrophilic surfactant, and aryl ethoxylate.

Aryl Ethoxylate

An aryl ethoxylate may have the general formula (I):

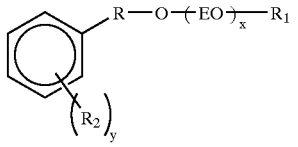

(I)

where x is an integer from 2 to 6; y is an integer from 0 to 5; R is a bond or ($C_1$–$C_4$)alkylene; $R_1$ is a hydrogen, halo, aryl, ($C_1$–$C_4$)alkyl, heteroaryl, cycloalkyl, or heterocycyl; and $R_2$ is independently selected from hydrogen, halo, ($C_1$–$C_4$)alkyl, ($C_1$–$C_4$)alkoxy, ($C_2$–$C_4$) alkenylene. Preferred ethoxylates are those derived from phenol itself and benzyl alcohol and those containing 2, 3, 4, 5, 6, 7, 8, 9, 10, 11, 12, 13, 14, or IS ethoxylate groupings. Especially preferred is "Ethylan HB4" which is a phenol ethoxylate containing around 4 ethoxylate units.

The aryl ethoxylate is surprisingly useful in coupling the hydrophobic surfactant into water or hydrophilic surfactant to form a stable concentrate and in coupling the hydrophobic surfactant into the hydrophilic surfactant or water upon dilution to a use solution. Thus, the aqueous and/or non-aqueous concentrate and aqueous use solution version of the inventive composition remains stable as, for example, a single phase or micro emulsion.

Ethoxylated aryl alcohol may be produced by reacting a desired alcohol with a desired number of ethoxylate moles at standard reaction conditions such as, 30–40 psi pressure, 300–360 degree F., with 0.2–0.5 wt % catalyst neutralized with acid. The reaction can be illustrated by the following:

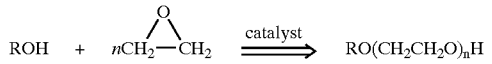

As will be apparent to those skilled in the art, the above-listed aryl ethoxylates are merely illustrative and various other aryl ethoxylates meeting the criteria set out above may also be used in the practice of the invention. The aryl ethoxylate may be present in the composition from 1 wt %, 10 to 90 wt % or 25 to 75 wt % based on the total weight of hydrophobic surfactant, and aryl ethoxylate.

The compositions may further include hydrotopes, enzymes, enzyme stabilizing system, chelating agents, sequestering agents, bleaching agents, an alkaline or acid source, secondary hardening agent or solubility modifier, detergent filler, defoamer, anti-redeposition agent, a threshold agent or system, aesthetic enhancing agent (i.e. dye, perfume, ect.) and the like. Adjuvant and other additive ingredients will vary according to the type of composition being manufactured and can be included in the compositions in any amount.

The above processes can be used to produce a product having a stable solution. The compositions can be diluted with aqueous and/or non aqueous materials to form a use solution of any strength depending on the application. The compositions and diluted use solutions may be useful as, for example, detergents for laundry, warewashing, vehicle care, sanitizing, and the like.

EXAMPLES

All of the following compositions were formed at ambient pressure and temperature. A formulation was created by combining the components in the amounts listed in the tables below.

FORMULATION A

| Component | Wt % |
|---|---|
| Tomadol 1-3 | 22.5 |
| Ethylan HB4 | 7.5 |
| TEA | 29 |
| LAS | 27 |
| Barlox 12 | 14 |

Tomadol 1-3 is an alcohol ethoxylate nonionic surfactant made from linear $C_{11}$ alcohol with 3 moles (average) of ethylene oxide with has an HLB of 8.7 and is commercially available from Tomah Products Inc. (Milton, Wis.). Ethylan HB4 is an ethylene glycol phenol ether (EPH) with 4 moles of ethylene oxide and is commercially available from Akzo Nobel N.V., (Arnhem, Netherlands). TEA (triethanol amine) is commercially available from Huntsman Chemical (Houston, Tex.). LAS (Linear Dodecyl Benzene Sulfonic Acid) is commercially available from Stepan Chemical (Northfield, Ill.). Barlox 12 is a cocamine oxide (CAS# 61788-90-7) commercially available from the Lonza Inc. (Switzerland) and is 30% active.

FORMULATION B

| Component | Wt % |
|---|---|
| Tomadol 1-3 | 15 |
| Ethylan HB4 | 15 |
| TEA | 29 |
| LAS | 27 |
| Barlox 12 | 14 |

Formulation A and Formulation B above provide a cleaning solution that can be used as a dilutable cleaner/degreaser for both food soils and greasy soils and is compatible with stainless steel, aluminum and other hard surfaces, and the like. Formulation A and Formulation B also exhibits stability in the above concentrate form and when diluted to a use solution. The exemplary formulations can be used as an all purpose cleaner, floor cleaner, glass and stainless steel cleaner, manual pot and pan cleaner, degreaser, and the like.

Formulations C and D below have a varying amount of water and can be classified as either a concentrate or ready-to-use composition. These compositions form stable solutions and may be further diluted with water or solvent to any desired strength depending on end use. Formulation C is an example of a 50% dilution. Formulation D is an example of a 5% dilution.

FORMULATION C

| Component | Wt % |
|---|---|
| Tomadol 1-3 | 11.25 |
| Ethylan HB4 | 3.75 |
| TEA | 14.5 |
| LAS | 13.5 |
| Barlox 12 | 7 |
| Water | 50 |

FORMULATION D

| Component | Wt % |
|---|---|
| Tomadol 1-3 | 1.125 |
| Ethylan HB4 | 0.375 |
| TEA | 1.45 |
| LAS | 1.35 |
| Barlox 12 | 0.7 |
| Water | 95 |

Formulation E below is another example of a stable cleaning concentrate in accordance with the invention.

FORMULATION E

| Component | Wt % |
|---|---|
| Tomadol 1-3 | 15 |
| Ethylan HB4 | 15 |
| TEA | 29 |
| Tall Oil Fatty acid | 27 |
| Barlox 12 | 14 |

Formulation F below is another example of a stable cleaning concentrate in accordance with the invention.

| FORMULATION F | |
|---|---|
| Component | Wt % |
| Hetoxol L 02 | 15 |
| Ethylan HB4 | 15 |
| TEA | 29 |
| LAS | 27 |
| Barlox 12 | 14 |

Hetoxol L 02 (POE-2 Lauryl Ether —CAS# 9002-92-0) is a nonionic $C_{18}$ alkyl with 2 moles of EO with an HLB of 6.1 and is commercially available from Heterene Inc.

Formulation G below is another example of a stable cleaning composition in accordance with the invention.

| FORMULATION G | |
|---|---|
| Component | Wt % |
| Tomadol 1-3 | 15 |
| Ethylan HB4 | 15 |
| TEA | 6 |
| LAS | 4 |
| Barlox 12 | 2.5 |
| Water | 57.5 |

As illustrated in the chart below, Ethylan HB4 and Tomadol 1-3 were combined to form a mixture in the specified amounts and then were diluted with water and visually observed to determine is the solution remained stable. Microemulsions and clear solutions indicate that the solution was stable.

| Ethylan | Tomadol | % mixture in water | | | |
|---|---|---|---|---|---|
| HB4 | 1-3 | 5 | 10 | 15 | 20 |
| 50 | 50 | Milky | Milky | Milky | Clear |
| 55 | 45 | Milky | Milky | Microemulsion | Clear |
| 60 | 40 | Milky | Microemulsion | Clear | Clear |
| 65 | 35 | Micro-emulsion | Clear | Clear | Clear |

As illustrated in the chart below, Ethylan HB4 and Surfonic L24-1.3 were combined to form a mixture in the specified amounts and then were diluted with water and visually observed to determine is the solution remained stable. Microemulsions and clear solutions indicate that the solution was stable.

| Ethylan | Surfonic | % mixture in water | | | | | |
|---|---|---|---|---|---|---|---|
| HB4 | L24-1.3 | 5 | 10 | 15 | 20 | 25 | 30 |
| 50 | 50 | Milky | Milky | Milky | Milky | Milky | Clear |
| 55 | 45 | Milky | Milky | Milky | Milky | Microemulsion | Clear |
| 60 | 40 | Milky | Milky | Clear | Microemulsion | Clear | Clear |
| 65 | 35 | Milky | Clear | Microemulsion | Clear | Clear | Clear |
| 70 | 30 | Milky | Microemulsion | Clear | Clear | Clear | Clear |
| 75 | 25 | Microemulsion | Clear | Clear | Clear | Clear | Clear |

As in the above tables, stable aqueous dilutions of hydrophobic surfactant and aryl ethoxylate can be formed in the absence of any other substance.

The present invention should not be considered limited to the particular examples described above, but rather should be understood to cover all aspects of the invention as fairly set out in the attached claims. Various modifications, equivalent processes, as well as numerous structures to which the present invention may be applicable will be readily apparent to those of skill in the art to which the present invention is directed upon review of the instant specification.

I claim:

1. A composition comprising:

(a) a surfactant having an HLB value from 1 to 10; and (b) a compound of formula (I):

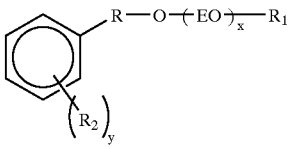

(I)

wherein:

x is an integer from 2 to 6;

y is an integer from 0 to 5;

R is a bond or $(C_1–C_4)$alkylene;

$R_1$ is a hydrogen, halo, aryl, $(C_1–C_4)$alkyl, heteroaryl, cycloalkyl, or heterocycyl;

$R_2$ is independently selected from hydrogen, halo, $(C_1–C_4)$alkyl, $(C_1–C_4)$alkoxy, $(C_2–C_4)$ alkenylene: and wherein the compound of formula (I) is present from greater than 10 to 90 wt % based on total weight of surfactant having an HLB value from 1 to 10, and the compound of formula (I).

2. The composition according to claim 1, wherein x is an integer from 2 to 4, y is 0, R is a bond or methylene, and $R_1$ is hydrogen.

3. The composition according to claim 1, wherein x is 4, y is 0, R is a bond or methylene, $R_1$ is hydrogen.

4. The composition of claim 1, further comprising a second surfactant having an HLB value greater than 10 or water.

5. The composition according to claim 1, wherein the surfactant having an HLB value from 1 to 10 is a primary alcohol ethoxylate, a secondary alcohol ethoxylate, a ternary alcohol ethoxylate, a primary amine ethoxylate, a secondary amine ethoxylate or mixtures thereof.

6. The composition according to claim 1, wherein the surfactant having an HLB value from 1 to 10 is a compound of formula (II):

$$R'—O—(EO)_a(PO)_bR'' \quad (II)$$

wherein:

a is an integer from 1 to 10;

b is an integer from 0 to 5;

R' is $(C_6–C_{22})$alkyl, $(C_6–C_{22})$alkoxy, $(C_6–C_{22})$ alkenylene with the proviso that when R' is $C_6$ alkyl, $C_6$ alkoxy, or $C_6$ alkenylene, a is at least 1 and b is at least 1; and R" is a hydrogen, halo, aryl, $(C_1–C_4)$alkyl, heteroaryl, cycloalkyl, or heterocycyl.

7. The composition according to claim 6, wherein a is an integer from 1 to 5, b is 0, R' is $(C_8–C_{16})$alkyl, and R" is hydrogen.

8. The composition according to claim 4, wherein the second surfactant having an HLB greater than 10 is an anionic surfactant, a cationic surfactant, a nonionic, an amphoteric surfactant, or mixtures thereof.

9. The composition according to claim 1, wherein the compound of formula (I) is present from 25 to 75 wt % based on total weight of surfactant having an HLB value from 1 to 10, and compound of formula (I).

10. A method of forming a stable cleaning composition comprising combining;

(a) a surfactant having an HLB value from 1 to 10;

(b) a compound of formula (I):

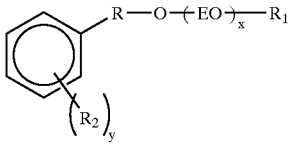

(I)

wherein;

x is an integer from 2 to 6;

y is an integer from 0 to 5;

R is a bond or $(C_1–C_4)$alkylene;

$R_1$ is hydrogen, halo, aryl, $(C_1–C_4)$alkyl, heteroaryl, cycloalkyl, or heterocycyl;

$R_2$ is independently selected from hydrogen, halo, $(C_1–C_4)$alkyl, $(C_1–C_4)$alkoxy, $(C_2–C_4)$ alkenylene;

wherein the compound of formula (I) is present from greater than 10 to 90 wt % based on total weight of surfactant having an HLB value from 1 to 10, and compound of formula (I); and (c) a second surfactant having an HLB value greater than 10 forming a stable non-aqueous cleaning concentrate or water forming an aqueous cleaning concentrate.

11. The method according to claim 10, wherein further comprising diluting the stable non-aqueous cleaning concentrate to form a stable aqueous use solution or diluting the stable aqueous cleaning concentrate to form a stable aqueous use solution.

12. The method according to claim 10, wherein the combining a compound of formula (I) comprises combining a compound of formula (I) wherein x is an integer from 2 to 4, y is 0, R is a bond or methylene, and $R_1$ is hydrogen.

13. The method according to claim 10, wherein the combining a surfactant having an HLB value from 1 to 10 comprises a compound of formula (II):

$$R'—O—(EO)_a(PO)_bR'' \quad (II)$$

wherein;

a is an integer from 1 to 10;

b is an integer from 0 to 5;

R' is $(C_6–C_{22})$alkyl, $(C_6–C_{22})$alkoxy, $(C_6–C_{22})$ alkenylene with the proviso that when R' is $C_6$ alkyl, $C_6$ alkoxy, or $C_6$ alkenylene, a is at least 1 and b is at least 1; and R" is hydrogen, halo, aryl, $(C_1–C_4)$alkyl, heteroaryl, cycloalkyl, or heterocycyl.

14. The method according to claim 13, the combining a surfactant having an HLB value from 1 to 10 comprises a compound of formula (II) where a is an integer from 1 to 5, b is 0, R' is $(C_8–C_{16})$alkyl, and R" is hydrogen.

15. The method according to claim 13, wherein the combining comprises combining a weight ratio of compound (I) to compound (II) of 1:3 to 3:1.

16. The method according to claim 15, wherein the combining a second surfactant comprises combining an amine salt of a fatty acid anionic surfactant.

17. The method according to claim 16, wherein the combining a second surfactant comprises combining a reaction product of a sulfonic acid and an alcohol amine.

18. The method according to claim 16, wherein the combining a second surfactant comprises combining a reaction product of a dodecyl benzene sulfonic acid and triethanol amine.

19. The method according to claim 15, wherein the combining a second surfactant further comprises combining an amine oxide.

* * * * *